US005203410A

United States Patent [19]

Cobb et al.

[11] Patent Number: 5,203,410

[45] Date of Patent: Apr. 20, 1993

[54] BLOWOUT SAFETY SYSTEM FOR SNUBBING EQUIPMENT

[75] Inventors: Charles C. Cobb, Frisco; Tibor Laky, Dallas, both of Tex.

[73] Assignee: Otis Engineering Corporation, Carrollton, Tex.

[21] Appl. No.: 809,934

[22] Filed: Dec. 18, 1991

[51] Int. Cl.[5] ..... E21B 33/03

[52] U.S. Cl. ..... 166/95; 166/332

[58] Field of Search ..... 166/373, 336, 340, 53, 166/80, 84, 88, 77, 173, 95

[56] References Cited

U.S. PATENT DOCUMENTS

| | | | |
|---|---|---|---|
| 3,128,614 | 4/1864 | Auer | 166/84 X |
| 3,955,623 | 11/1976 | Aumann | 166/340 |
| 3,999,610 | 12/1976 | Sage et al. | 166/77 |
| 4,085,796 | 4/1978 | Council | 166/77.5 |
| 4,356,867 | 11/1982 | Carmody | 166/373 |
| 4,415,026 | 11/1983 | Regewski et al. | 166/84 X |
| 4,440,231 | 4/1984 | Martin | 166/373 |
| 4,456,063 | 6/1984 | Roche | 166/84 |
| 4,473,122 | 9/1984 | Tamplen | 166/373 |
| 4,480,843 | 11/1984 | Springer | 166/173 |
| 4,531,887 | 7/1985 | Fineberg | 166/373 |
| 4,889,184 | 12/1989 | Lugtmeier | 166/80 |
| 4,907,650 | 3/1990 | Heinonen | 166/80 |
| 4,971,148 | 11/1990 | ROche et al. | 166/88 |

OTHER PUBLICATIONS

*Otis Hydraulic Workover and Snubbing Equipment Services*, Feb. 881520/6M, copyright 1989, Otis Engineering Corporation.

*Primary Examiner*—Ramon S. Britts
*Assistant Examiner*—Frank S. Tsay
*Attorney, Agent, or Firm*—Ross, Howison, Clapp & Korn

[57] ABSTRACT

A blowout safety system particularly preferred for use in providing emergency protection when blowouts occur during snubbing operations due to unexpected surges in downhole pressure. The safety system comprises a spring biased valve assembly having a flapper adapted to seal off the upward flow of well fluids through the wellhead immediately upon expulsion of the well tubulars when a blowout occurs, and a port within the valve assembly for simultaneously diverting the upward flow of well fluids to a location remote from the well when the flapper closes.

11 Claims, 3 Drawing Sheets

BLOWOUT SAFETY SYSTEM FOR SNUBBING EQUIPMENT

BACKGROUND OF THE INVENTION

1. Field of the Invention

This invention relates to hydraulic workover equipment for use in servicing oil and gas wells, and more particularly, to a blowout safety system suitable for use during snubbing operations.

1. Description of Related Art

As tubular members such as pipe or reeled tubing are run into a well during snubbing operations or other well servicing procedures, pockets of gas may be encountered that produce surges in well pressure. Whenever the downhole pressure exceeds the weight of the pipe in a well bore, sometimes referred to as the "light pipe" mode, positive force must be exerted on the pipe to prevent it from being blown out the top of the well. This positive force is normally exerted on the pipe by means of a hydraulic jack comprising sets of diametrically opposed hydraulic cylinder assemblies having piston rods that raise and lower upper traveling slips. Two sets of lower slips are mounted in axial alignment below a guide tube assembly, one for holding the pipe against the well pressure and one for supporting the weight of the heavy pipe while resetting the upper traveling slips. The hydraulic cylinder assemblies of the jack are operated from a control panel that is situated on the work platform or basket of the workover rig, or located nearby.

If the grip on the pipe is lost due to a sudden pressure surge while operating in the light pipe mode, the well pressure can force the pipe upward and out of the well bore through the center of the hydraulic jack. Although conventional blowout preventers are utilized during snubbing operations, well fluids and acids may escape upward through the center of the jack, thereby endangering personnel on the work platform before the blowout preventers can shut down the well. Blowout preventers are normally hydraulically operated, and may require several seconds to seal off the well and stop the flow. For the protection of personnel and equipment, a blowout safety system is therefore needed that is characterized by a safety valve having a shorter response time than that of the conventional, commercially available blowout preventers.

U.S. Pat. No. 4,085,796 discloses a well tubing handling system comprising a hydraulic jack and slip assembly of the type suitable for use in snubbing operations.

U.S. Pat. No. 4,473,122 discloses a downhole safety system comprising a valve that is set downhole to prevent the undesired escape of well fluids while moving a work string through the bore of a production tubing string. The downhole safety valve has a flapper closure means that can be mechanically opened by inserting a work string through the safety valve and that will close when the work string is withdrawn. The flapper is biased toward the closed position by a torsion spring disposed on the hinge pin, and when closed, seals off fluid flow through the production tubing.

U.S. Pat. No. 4,889,184 discloses a wellhead assembly for use with a reciprocating rod pump. The assembly comprises a polished rod stuffing box with a safety valve for sealing off the wellhead in case of polished rod failure. The safety valve utilizes a flapper that is biased against the polished rod by a torsion spring. When the polished rod is removed, either intentionally or through failure, the flapper seals off the wellhead. In such wells, however, there is typically little if any downhole pressure to be retained, and the primary function of the safety valve is to prevent the escape of potentially dangerous gases.

U.S. Pat. No. 4,907,650 discloses another wellhead assembly for use with a reciprocating rod pump. The assembly comprises a flapper valve that is normally spring biased toward the open position, and that is closed by a plunger attached to a transversely mounted piston adapted to force the flapper closed against the spring bias in the event of polished rod failure or removal.

SUMMARY OF THE INVENTION

According to the present invention, an emergency blowout safety system for oil and gas wells is provided that is specially adapted for use during snubbing operations or other similar well servicing procedures. Unlike the devices, methods and systems disclosed in the prior art, the system disclosed herein is adapted to simultaneously (1) block the upward flow of well fluids through the guide tube assembly of a hydraulic jack; and (2) divert the flow laterally into a pit or other containment if a blowout occurs due to a sudden pressure surge in the well bore. The system of the invention thereby provides an additional measure of protection until the well bore can be sealed off with a conventional blowout preventer or other suitable device.

According to one preferred embodiment of the invention, a blowout safety system is provided that comprises a normally closed valve assembly adapted to block the upward flow of well fluids through a wellhead during an open hole emergency in combination with means for diverting the upward flow of well fluids away from the well.

According to another preferred embodiment of the invention, a wellhead safety valve assembly is provided that comprises a body having upper and lower ports; a hinge-mounted closure member disposed inside the body between the upper and lower ports, the closure member being biased toward a normally closed position blocking the upper port but rotatable to an open position upon the introduction of a tubular member downwardly through the upper port; and means for receiving a pressurized flow of well fluids into the body through the lower port upon removal of the tubular member and for diverting the pressurized flow to a pit or other containment means remote from the wellhead.

According to another embodiment of the invention, a snubbing equipment safety valve is provided that comprises a valve body; means for attaching the valve body to a wellhead below the slips of a hydraulic jack; vertically aligned ports in the body adapted to accommodate well tubulars passed vertically through the valve; a spring-biased, normally closed flapper adapted to seal the top valve port whenever the well tubulars are withdrawn from the valve; and at least one other port in the valve body that is in fluid communication with a fluid discharge zone remote from the wellhead whenever the outlet port is closed by the flapper.

According to a particularly preferred embodiment of the invention, a wellhead safety valve is provided that further comprises means for selectively overriding the force biasing the flapper against well tubulars or tools passed through the valve to avoid hangup. Hydraulic, pneumatic or manually operable override means can be employed within the scope of the invention.

According to another embodiment of the invention, a method is disclosed for providing emergency protection in the event of a blowout during snubbing operations. The method preferably comprises the steps of blocking the upward flow of well fluids through the snubbing equipment and simultaneously diverting the flow of well fluids to a location remote from the well, such as a pit or other containment means.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
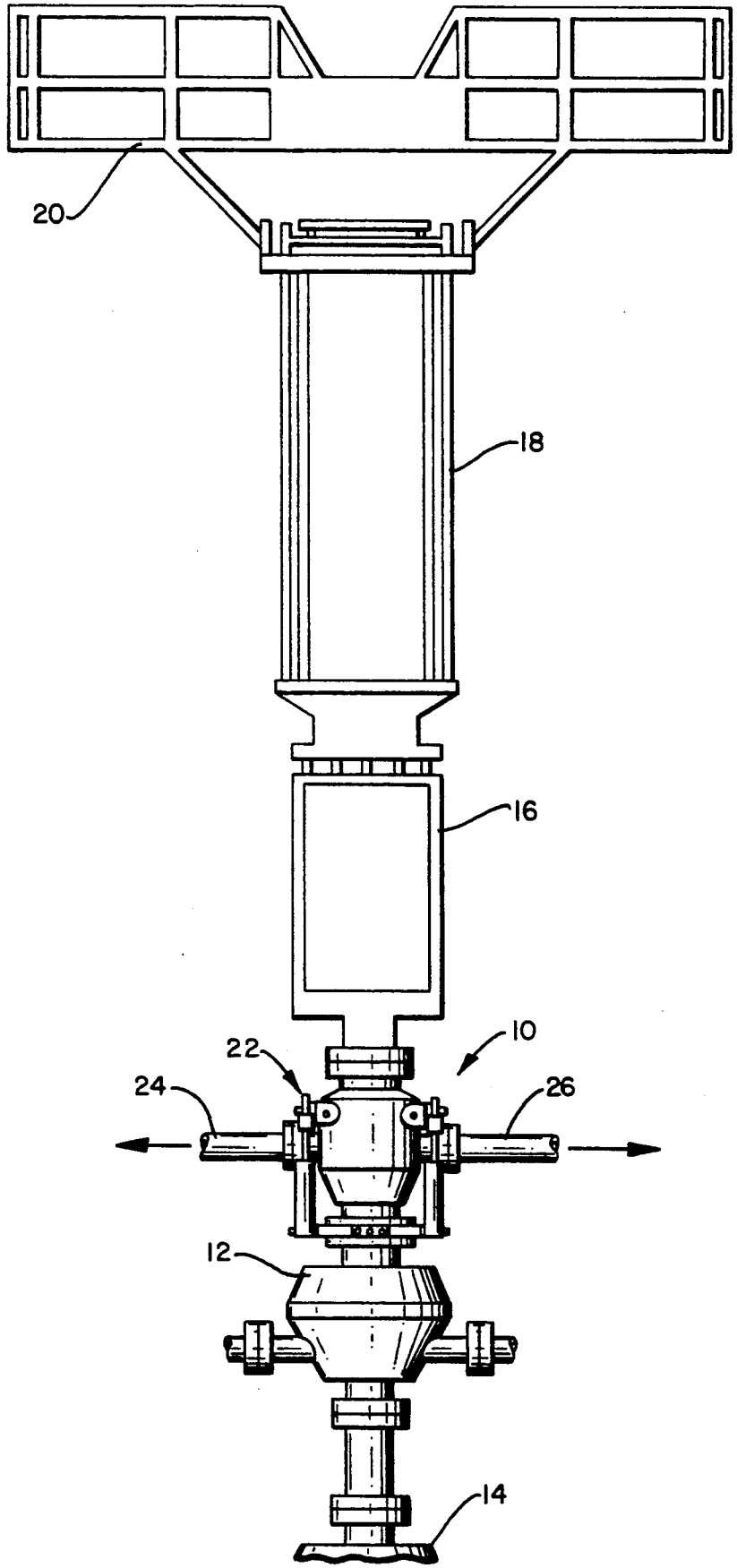
FIG. 1 is a schematic elevation view depicting the blowout safety system of the invention as installed with other wellhead equipment suitable for use in a snubbing operation.

Blowout safety system 10 of the invention is preferably installed at the wellhead for use in a snubbing operation as shown schematically in FIG. 1. Blowout safety system 10 is desirably situated above a stack of conventional blowout preventers 12, 14, and below stationary slip bowls 16, hydraulic jack 18 and work platform 20. The structure and operation of a conventional well tubing handling system suitable for use in snubbing operations is more completely described and explained in U.S. Pat. No. 4,085,796.

Blowout safety system 10 preferably comprises as its principal elements safety valve 22 adapted to block the upward flow of well fluids through the wellhead if a blowout occurs due to a sudden pressure surge in the well bore, and at least one side outlet pipe adapted to divert the upward flow of well fluids laterally into a pit or other containment until the conventional blowout preventers can be closed to seal off the well bore. As shown in FIG. 1, two side outlet pipes 24, 26 are provided to better accommodate and alleviate any such pressure surge that might occur. By diverting any upward flow of pressurized fluids away from the wellhead, emergency protection is provided to operating personnel on work platform 20 or nearby the wellhead who might otherwise be subjected to hazardous acids, gases, or the like.

Figure 3:
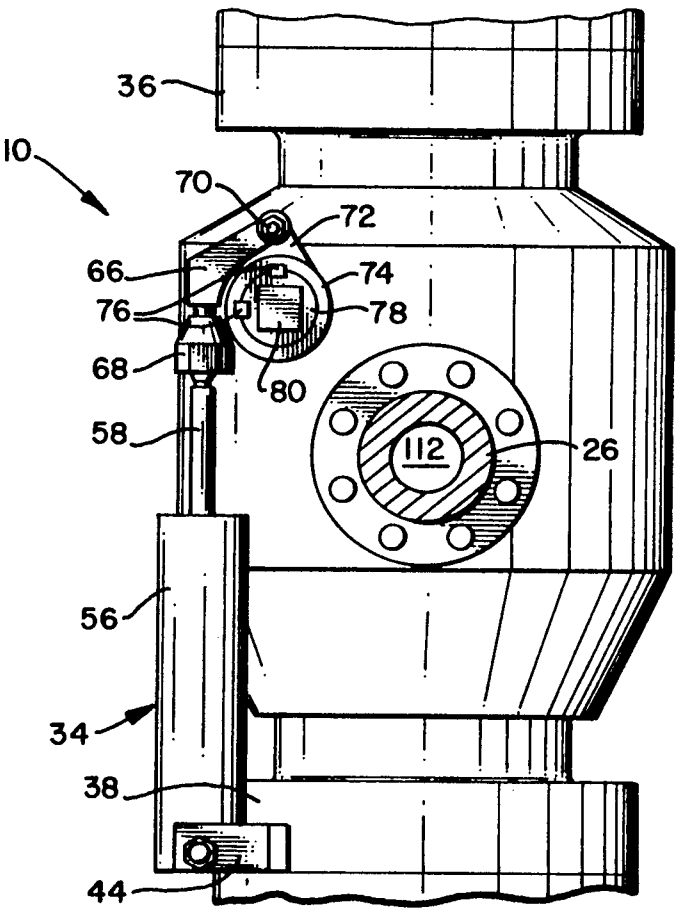
FIG. 3 is a side elevation view of the blowout safety system of FIG. 2.
Figure 2:
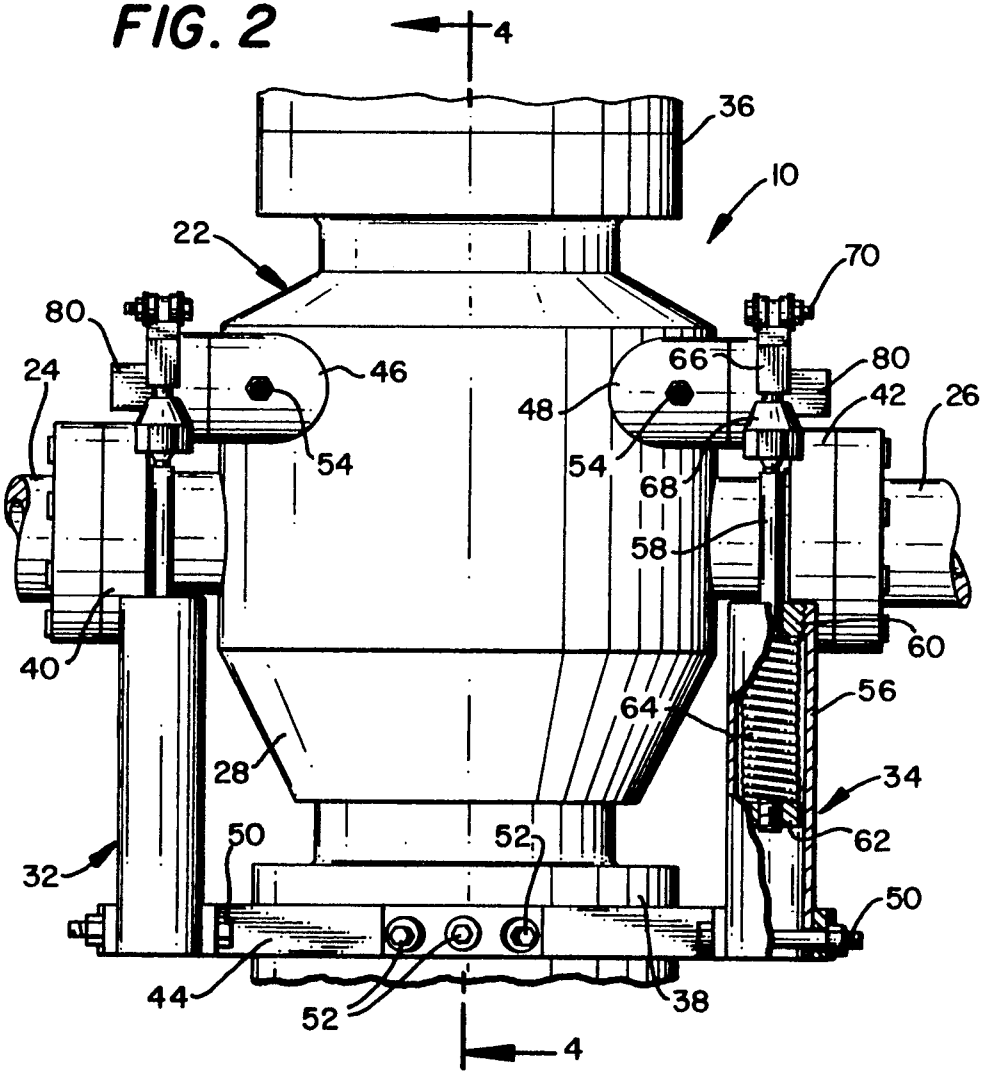
FIG. 2 is a front elevation view of the blowout safety system of the invention as shown in FIG. 1.

The external structure of a preferred embodiment of safety valve 22 is further described and explained in relation to FIGS. 2 and 3. Referring to FIG. 2, safety valve 22 further comprises body 28 and spring housing assemblies 32, 34. Body 28 further comprises top flange 36, bottom flange 38, and side outlet flanges 40, 42. Body 28 and the respective flanges are all preferably constructed from steel and comply with the relevant American Petroleum Institute specifications for such equipment. Bolt holes 30 for connecting top and bottom flanges 36, 38 to the flanges of adjacent equipment are shown in FIG. 3.

Spring housing assemblies 32, 34 are preferably secured to weldments on spring housing anchor plate 44 by means such as bolts 50 in such manner that each spring housing assembly can pivot away from body 28 around bolts 50. Spring housing anchor plate 44 is secured in fixed relation to bottom flange 38 of body 28 by means such as bolts 52.

Each spring housing assembly 32, 34 preferably further comprises cylinder 56, spring activating rod 58, rod guide 60, spring support plate 62, coil spring 64, articulated connecting arm 66, and threaded connector 68. Rod guide 60 is preferably threaded into the top of cylinder 56 and comprises a centrally disposed bore adapted to slidably engage spring activating rod 58. Spring support plate 62 slidably engages the inside wall of cylinder 56 and is preferably threaded onto the lower end of spring activating rod 58. As shown in FIG. 2, spring 64 is compressed due to the upward extension of spring activating rod 58 relative to cylinder 56 for reasons that are discussed in relation to FIGS. 3 and 4 below. Cylinder 56, spring activating rod 58 and coil spring 64 are preferably sized and constructed so that spring support plate 62 does not pass beyond the bottom of cylinder 56 whenever coil spring 64 is relaxed from the position shown in FIG. 2, and spring activating rod 58 reaches the lowest position in its range of travel.

Referring to FIG. 2, the upper end of articulated connecting arm 66 is preferably rotatably secured by means such as bolt 70 to operating arm 72, which is in turn connected in fixed relation to operating arm sleeve 74. Referring to FIGS. 2 and 3, means such as operating arm weldments 46, 48 are desirably provided on opposite sides of body 28 to rotatably support flapper valve operating shaft 78, which extends outwardly through each side of body 28 inwardly of operating arm sleeves 74. Grease fittings 54 are provided for use in lubricating bearings (not shown) disposed inside weldments 46, 48. Referring to FIG. 3, operating arm sleeve 74 is preferably releasably secured in fixed rotational relation to flapper valve operating shaft 78 by means of keys 76 inserted into oppositely disposed, cooperating grooves in both the sleeve and shaft. It is understood, however, that any other similarly effective means can likewise be used within the scope of the invention.

Figure 4:
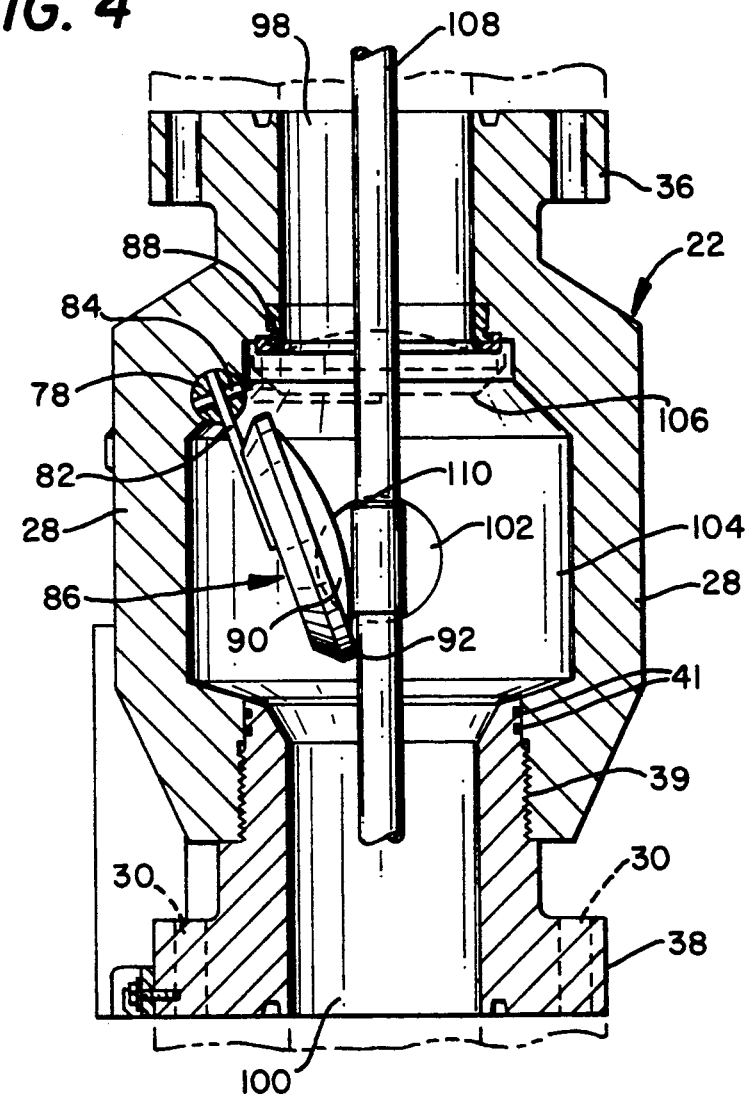
FIG. 4 is an elevation view, partially in section, taken along line 4—4 of FIG. 2.
Figure 5:
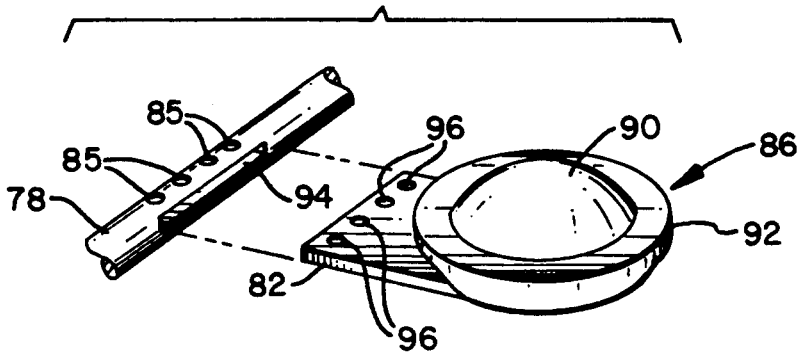
FIG. 5 is an exploded detail perspective view of the flapper assembly depicted in FIG. 4 for use in the blowout safety system of the invention.

The internal structure of safety valve 22 is further described and explained in relation to FIGS. 4 and 5. As shown in FIG. 4, bottom flange 38 is preferably connected to the bottom of body 28 by threads 39 to facilitate access to interior cavity 104 of safety valve 22 during assembly and servicing. A plurality of O-rings 41 preferably provide a fluid seal above threads 39. Port 98 is disposed in the top of body 28, and port 100, coaxially aligned with port 98, is defined by the interior of bottom flange 38. Valve seat 88 is preferably disposed in the upper portion of interior cavity 104 below port 98. Side outlet port 102, communicating with the interior of side outlet pipe 24 as shown in FIG. 2, is also seen in FIG. 4. Similarly, side outlet port 112 communicating with the interior of side outlet pipe 26 is seen in FIG. 3, but is not visible in FIG. 4.

According to a preferred embodiment of the invention, flapper 86 is disposed inside interior cavity 104, and is releasably secured in fixed relation to flapper valve operating shaft 78 by flapper arm 82 and pins 84. Referring to FIG. 5, flapper 86 preferably comprises circumferentially extending edge 92 with domed surface 90 spaced radially inward therefrom. Flapper arm 82 is preferably attached by welding to the back side of flapper 86. Although any suitable means can be used for securing flapper arm 82 to flapper valve operating shaft 78, one satisfactory method of attachment is the insertion of flapper arm 82 into slot 94 in the shaft in such manner that holes 85, 96 are aligned, after which pins 84 are inserted through the aligned holes 85, 96. Once flapper 86 is installed in body 28 and flapper valve operating shaft 78 is connected to spring housing assemblies 32, 34, holes 85, 96 are preferably rotated to a position where pins 84 are held in place by body 28.

According to the preferred method of the invention, safety valve 22 of blowout safety system 10 is normally closed. Until a well tubular 108 such as pipe or reeled tubing is introduced through port 98 into interior cavity 104 of body 28, flapper 86 is biased against valve seat 88 (as shown in phantom outline by flapper 106 in FIG. 4) by the force of coil spring 64 acting against rod guide 60 through rod 58, articulated connecting arm 66, operating arm 72, operating arm sleeve 74, flapper valve operating shaft 78 and flapper arm 82. When a well tubular 108 is run into the well, the first tool or tubular introduced through safety valve 22 contacts domed surface 90 of flapper 86, causing flapper 86 to rotate downward inside interior cavity 104 of body 28. As flapper 86 is rotated downward, flapper valve operating shaft 78 is rotated in a clockwise direction to the position shown in FIGS. 2, 3 and 4. This rotation causes operating arm 72 to pull articulated connecting arm 66 upwards, simultaneously pulling rod 58 upwardly through rod guide 60 and compressing coil spring 64 between rod guide 60 and spring support plate 62. As operating arm 72 pulls articulated connecting arm 66 and rod 58 upwards, cylinder 56 also pivots angularly toward flapper valve operating shaft 78 around bolts 50 to the position shown in FIGS. 2 and 3.

In the event of a blowout, or at any other time when well tubular 108 is withdrawn from the interior of safety valve 22, coil spring 64 will force rod 58 downward again, causing flapper valve operating shaft 78 to rotate flapper 86 back to its normally closed position in contact with valve seat 88. If a blowout occurs, the pressurized fluids forced upwardly through the well bore will also assist in forcing flapper 86 into fully seated engagement with valve seat 88. When flapper 86 engages valve seat 88, blocking the fluid path upwards through the wellhead, any pressurized well fluids being propelled upwardly through the well bore and port 100 of safety valve 22 are immediately diverted through side outlet ports 102, 112 and side outlet pipes 24, 26, respectively. According to a preferred embodiment of the invention, side outlet pipes 24, 26, which are broken away in FIGS. 1 and 2 for ease of illustration, discharge the well fluids into a pit or other containment previously determined to be suitable for use in such an emergency.

A primary purpose of blowout safety system 10 of the invention is to provide immediate emergency protection when pipe or reeled tubing is blown upwardly out of the well bore, and to dissipate such pressure surges as may be experienced until the conventional blowout preventers can be closed to shut in the well. For this reason, side outlet ports 102, 112 and side outlet pipes 24, 26 preferably remain open during normal low pressure snubbing operations or other relevant well servicing procedures, and side outlet ports 102, 112 should have a combined cross-sectional area at least as great as the cross-sectional area sealed by flapper 86. Conventional strippers deployed below safety valve 22 are typically adequate for limiting any appreciable flow of well fluids through side outlet ports 102, 112 during such normal operations. Where snubbing operations are conducted in a well regularly exhibiting higher downhole pressures, it will be appreciated that other appropriate means can be installed on side outlet pipes 24, 26 to prevent the escape of well fluids through side outlet ports 102, 112 during regular operations, provided that such means are adapted to open automatically upon reaching a predetermined emergency pressure level.

Because flapper 86 is biased by the force of coil spring 64 against well tubulars 108 and other well tools introduced into the well bore through safety valve 22, the potential for hangup exists whenever such well tubulars or well tools are subsequently withdrawn. Although minor upsets such as shoulder 110 on well tubular 108 shown in FIG. 4 will normally pass over edge 92 of flapper 86 without difficulty, means are desirably provided as part of safety valve 22 for overriding coil spring 64 to disengage flapper 88 from any such obstruction if desired. According to one preferred embodiment of the invention, square ends 80 are provided at each end of flapper valve operating shaft 78 to facilitate the attachment of a wrench that can be used to rotate the shaft and attached flapper 88 away from an obstruction against the spring pressure. According to another embodiment of the invention, either of spring housing assemblies 32, 34 can be assisted with a conventional cylinder having a pneumatically or hydraulically actuated piston that can be selectively operated to override the usual operation of coil spring 64 when desired.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A blowout safety system adapted to provide emergency protection at the wellhead of oil and gas wells, the system comprising:

flapper valve means biased toward a closed positions, said flapper valve means being adapted to move to the closed position and thereby block and upward flow of well fluids through the wellhead immediately following a blowout;

means disposed below the flapper valve means for diverting the upward flow of well fluids after closure of the flapper means to a location remote from the wellhead; and means for selectively overriding the bias on the flapper valve means.

2. The blowout safety system of claim 1 wherein the means for selectively overriding the bias on the flapper valve means is pneumatically or hydraulically controlled.

3. A blowout safety system comprising a normally closed valve assembly adapted to block an upward flow of well fluids through a wellhead during a open hole emergency and means disposed blow the valve assembly for temporarily diverting the upward flow of well fluids away from the wellhead, the normally closed valve assembly comprising a flapper valve adapted to be opened by well tubulars introduced through the valve assembly, the flapper valve being biased to close whenever the well tubulars exit the valve assembly, and means for biasing the flapper valve against the well tubulars introduced through the valve assembly, and further comprising means for use in selectively overriding the bias to move the flapper valve away from the well tubulars as they exit the valve assembly.

4. A safety valve adapted for use at the wellhead to provide emergency protection from pressurized well fluids expelled from a well bore due to a blowout during well servicing operations, the safety valve comprising:

a body;

an interior cavity within the body;

top and bottom ports communicating with the interior cavity, the top and bottom ports being adapted to receive well tubulars and well tools introduced into the well bore through the safety valve;

an operating shaft extending transversely through the body adjacent to the interior cavity;

a valve seat disposed between the top port and the interior cavity;

a flapper disposed in the interior cavity and connected to the operating shaft;

means for biasing the operating shaft to rotate the flapper into engagement with the valve seat to seal the top port, the flapper being further adapted to disengage from the valve seat and thereby unseal the top port when contacted by a well tubular or well tool introduced into the well bore through the safety valve; and at least one side outlet port communicating with the interior cavity below the valve seat that is adapted to divert well fluids expelled from the well bore to a location remote from the wellhead immediately following a blowout.

5. The safety valve of claim 4 wherein the operating shaft is biased by at least one operatively coupled spring assembly.

6. The safety valve of claim 4 wherein the valve seat defines a first cross-sectional area, the side outlet ports define a second cross-sectional area, and the first cross-sectional area does not exceed the second cross-sectional area.

7. The safety valve of claim 4, further comprising means adapted for use in selectively overriding the bias on the operating shaft.

8. The safety valve of claim 7 wherein the means adapted for use in selectively overriding the bias on the operating shaft comprises means for attaching a wrench to the operating shaft.

9. The safety valve of claim 7 wherein the means adapted for use in selectively overriding the bias on the operating shaft comprises pneumatically or hydraulically actuated piston means.

10. A safety valve for use with snubbing equipment having a hydraulic jack and slips adapted to grip well tubulars snubbed through a wellhead into a well bore using the hydraulic jack, the safety valve comprising a valve body; means for attaching the valve body to the wellhead below the slips; vertically aligned top and bottom ports in the body adapted to accommodate well tubulars passed vertically through the valve into the well bore; a spring-biased, normally closed flapper adapted to seal the top port whenever the well tubulars are withdrawn from the valve; and at least one other port int eh valve body that is in fluid communication with a fluid discharge zone remote from the wellhead whenever the top port is closed by the flapper, further comprising means for selectively overriding the spring-biased flapper to avoid hand up during withdrawal of the well tubulars through the valve.

11. The safety valve of claim 10 wherein the means for selectively overriding the spring-biased flapper is hydraulically, pneumatically or manually actuated.

* * * * *